United States Patent [19]

Del Bianco et al.

[11] 4,363,455

[45] Dec. 14, 1982

[54] TAKE-UP ROLL MANDREL SLIP CLUTCH TENSIONING DEVICE

[75] Inventors: Matthew A. Del Bianco, Chesapeake Isle, North East, Md.; Henry J. Tancredi, Gwynedd, Pa.

[73] Assignee: E. I. Du Pont de Nemours and Company, Wilmington, Del.

[21] Appl. No.: 235,413

[22] Filed: Feb. 17, 1981

[51] Int. Cl.[3] ..... B65H 59/38

[52] U.S. Cl. ..... 242/75.5; 156/494; 156/495

[58] Field of Search ..... 156/494, 495, 537, 555; 242/45, 46.4, 65, 67.1, 67.3, 75.5; 192/85 C, 85 CA, 56 R, 56 F; 64/30 C, 30 R

[56] References Cited

U.S. PATENT DOCUMENTS

| | | | |
|---|---|---|---|
| 1,252,109 | 1/1918 | Heckman | 242/7.23 |
| 1,275,072 | 8/1918 | Moomy | 242/7.23 |
| 3,679,149 | 7/1972 | Ottavan | 242/75.5 |
| 3,727,856 | 4/1973 | Kitch | 242/75.5 |

*Primary Examiner*—Caleb Weston

[57] ABSTRACT

A tensioning device for the take-up roll in an automatic laminating apparatus is characterized by a clutch member attached to the roll, the clutch member having a clutch material thereon biased into an abutting interface with respect to a drive member. The drive member is rotated at a first predetermined angular velocity. The clutch material continuously slips along the interface with the drive member to impart a second, lesser, angular velocity.

1 Claim, 10 Drawing Figures

TAKE-UP ROLL MANDREL SLIP CLUTCH TENSIONING DEVICE

FIELD OF THE INVENTION

This invention relates to an apparatus for automatically laminating printed circuit boards with a dry film photopolymer resist material and, in particular, to a slip clutch tensioning device adapted to apply a tension force to the backup strip of the photopolymer resist material.

BACKGROUND ART

When using a dry film photopolymer resist material, such as that manufactured by E. I. du Pont de Nemours and Company, Inc. and sold under the trademark RISTON ®, it is necessary to laminate a layer of that material onto the surface of a circuit board or other substrate prefatory to exposure by actinic radiation. Typically, the layer of photopolymer resist material is laid over the surface of the substrate to be covered and the substrate and resist passed between the nip of heated laminating rolls. The surface of the substrate may be previously scrubbed to remove oxide layers and other contaminants therefrom. The scrubbing assists in the adhesion of the resist material to the substrate. If done manually, the preparation of the substrate and the introduction and removal thereof into and from the laminating rolls is time consuming and expensive.

It is advantageous to increase the throughput of the laminating operation by providing an apparatus adapted to automatically prepare the surface of the substrate, convey the prepared substrate to the lamination region which contains the heated laminating rolls, and thereafter remove laminated boards from the apparatus for further fabrication. However, in any automated apparatus certain minimum requirements are believed necessary in order to most efficiently and effectively laminate a resist layer to the surface of a substrate.

For example, if copper coated boards are to be laminated with a resist material, it is believed to be advantageous to utilize a conveyance arrangement which expeditiously translates the board from the region in which the surface thereof is scrubbed to the region in which the board is laminated in order to minimize the oxidation of the surface of the substrate to the fullest extent possible.

To avoid wastage of resist material, it is also desirable that individual boards be presented to the laminating rolls with as little a gap as possible between a given board and a trailing board. Thus, any conveyance arrangement should be adapted to avoid cumulative gapping between successive boards introduced into the lamination region. It is believed to be most desirable to provide a conveyance arrangement wherein successive boards are in an abutted relationship (tail-to-head) at the time one of the boards is introduced into the laminating rolls. Moreover, any conveyance arrangement should be able to maintain abutment between successive boards without regard to variations in board length from run to run. Since the boards being laminated are relatively thin planar members, it is also necessary that any conveyance arrangement be adapted to prevent board overlap. That is, the leading edge of a trailing board must not extend over or under the trailing edge of a leading board. Such an occurrence can potentially render inutile both boards.

In the lamination region itself, it is believed desirable to provide a mechanism whereby the laminating rolls are accurately brought into contact with the leading edge of a leading board in a run and (assuming the boards are butted) removed from contact as the trailing edge of the last trailing board exits the laminating rolls. Such a practice is advantageous in that it avoids wastage of resist material. Moreover, the laminating rolls should be susceptible to accurate opening and closing motions which would bring the rollers into contact with the surfaces of the board and predictably impart a predetermined pressure force to the board to laminate the resist layer thereto. The gap, or nip, formed between the rollers when the rollers are closed should, moreover, be predictably adjustable.

Once the board and resist material have been laminated, the laminate (i.e., substrate and resist layer adhered thereto) so formed should be automatically removable from the apparatus. With those resist materials which are provided with a backing strip the laminate may be moved through the apparatus incidentally to the take-up of the backing strip. When the backing strip is being taken-up, care must be exercised that proper tension is maintained on the strip. It is therefore believed advantageous to provide a slip clutch tension device to insure that the take-up tension force exerted by a take-up roller on the backing strip be held within appropriate limits.

While any portion of the laminate is still within the apparatus the laminate is subjected to a restraining force which tends to resist any displacing force imposed on the laminate to assist in its withdrawal from the apparatus. However, when laminate is drawn through the automated apparatus it is desirable to provide a structural arrangement whereby the laminate is separated from the backing strip and any unadhered resist present between the trailing edge of the laminate and the leading edge of the next-successive laminate. Accordingly, it is believed advantageous to provide a gripping arrangement adapted to grasp the laminate when a predetermined portion thereof has exited from the apparatus and to exert a force on the laminate which pulls it free from the trailing resist material when the backing strip is completely removed from the laminate.

SUMMARY OF THE INVENTION

This invention relates to a tensioning device for a take-up roll which, when driven, wraps upon itself the backup strip from a photopolymer resist material. In accordance with the invention one end of the mandrel of the take-up roll is provided with a clutch plate having a clutch material disposed on the surface thereof. The clutch material forms one side of a friction interface with a drive plate. The drive plate is rotated at a first predetermined angular velocity by a suitable drive arrangement. The clutch plate, and therefore the mandrel attached thereto, continuously slips along the friction interface with the drive plate, thus rotating the mandrel at a second angular velocity generally less than the first angular velocity. Such an arrangement permits the take-up roll to impose only that amount of tension force on the backup strip that is necessary to wrap the strip onto the roll, thereby preventing excessive forces from exerted upon the backup material being taken up by the take-up roll.

An axially directed pressure force is imposed on the opposite end of the mandrel by a pressure actuator mounted in a fixed location with respect to the mandrel.

The magnitude of the pressure force imposed on the mandrel affects the slippage along the interface between the clutch plate and the drive plate, thereby affecting the velocity at which the take-up roll is rotated. A spring loaded socket associated with the actuator is disposed so as to receive the opposite end of the mandrel. The socket is biased to a first position in which the mandrel is engaged thereby. The socket is displaceable in an axial direction with respect to the mandrel from the engaging to a release position so that interchange of the mandrel may be facilitated.

BRIEF DESCRIPTION OF THE DRAWINGS

The invention will be more fully understood from the following detailed description thereof taken in connection with the accompanying drawings which form a portion of this application and in which.

DETAILED DESCRIPTION OF THE INVENTION

Figure 1:
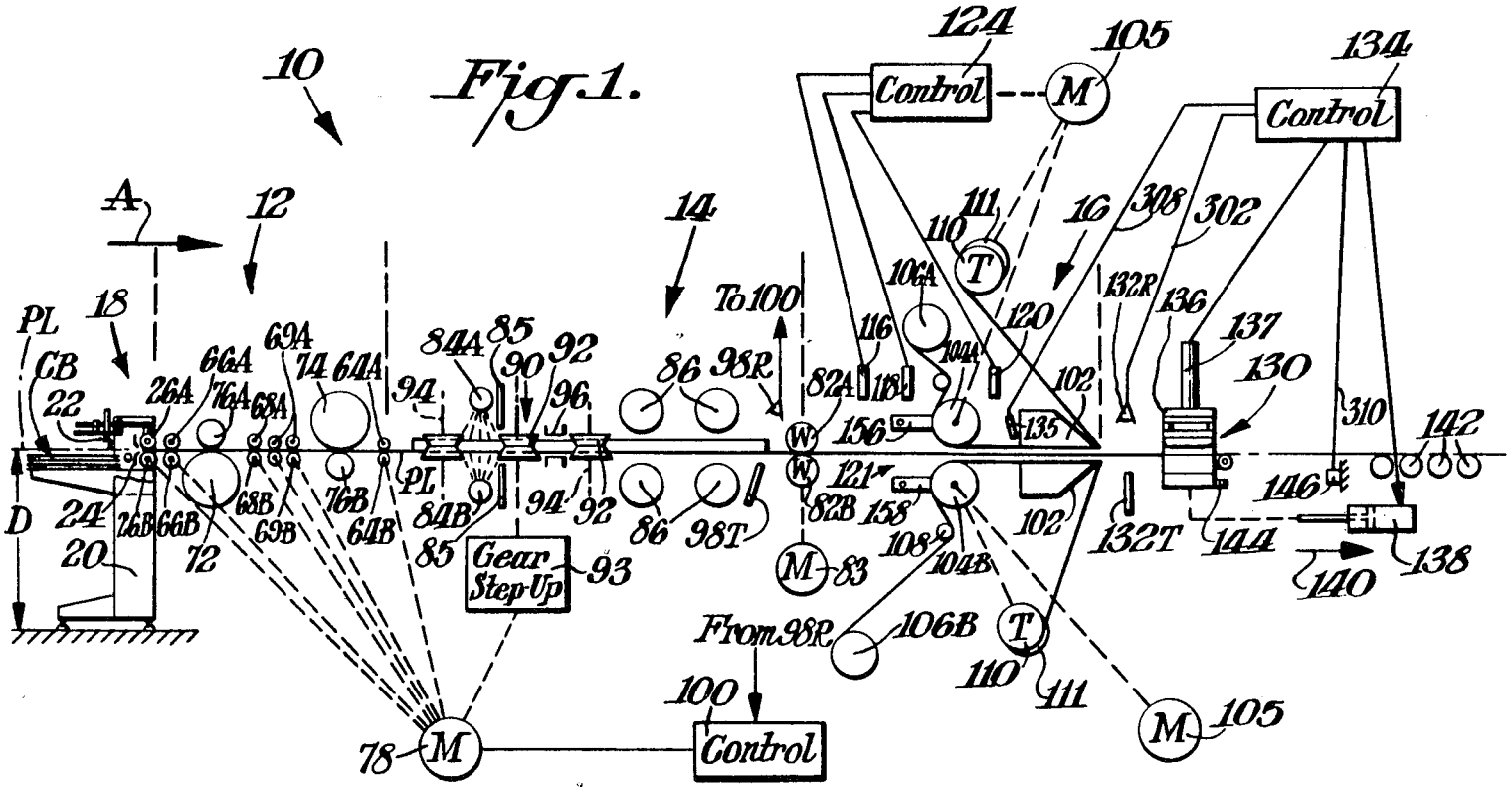
FIG. 1 is a stylized schematic representation of an apparatus for automatically laminating a circuit board with which the instant invention is utilized.

Throughout the following detailed description similar reference numerals refer to similar elements in all Figures of the drawings.

FIG. 1 is a highly stylized schematic representation of an apparatus 10 for automatically laminating individual circuit boards CB with a dry film photopolymer resist material such as that sold by E. I. du Pont de Nemours and Company, Inc. under the trademark RISTON®. The individual circuit boards CB able to be handled by the apparatus 10 in accordance with this invention are typically planar members having planar width dimensions ranging from twelve to eighteen inches and planar length dimensions ranging from fourteen to twenty-four inches. Individual circuit boards CB may have a thickness dimension in a range from 0.030 inches to 0.125 inches. The boards CB form the substrate upon which a layer of the resist material may be laminated to the upper surface, the lower surface or both surfaces of the board CB. The boards CB may be fabricated of a single copper plate or may themselves be laminates of several intermediate plates (commonly called "inner layers") with the upper and lower surfaces of the boards CB being copper.

The apparatus 10 is an integrated device which is able to perform each of the functions necessary to prepare an individual circuit board CB for the application of a dry film photopolymer resist material and to apply the resist material thereto. The apparatus 10 includes a brush cleaning region 12 (hereafter the "cleaning section"), a rinse and air-dry region 14 (hereafter the "rinsing section"), and a lamination region 16 (hereafter the "laminating section"). Individual circuit boards CB are introduced into the cleaning section 12 of the apparatus 10 by an in-feed arrangement 18.

The in-feed arrangement 18 includes a frame 20 having a pneumatic carrying element 22 mounted thereon. Individual circuit boards CB are lifted from a supply of boards and carried by the carrying element 22 to a lead-in guide 24 terminating at the nip of an inlet pair of nip rollers 26 disposed at the inlet of the cleaning section 12.

Figure 2:
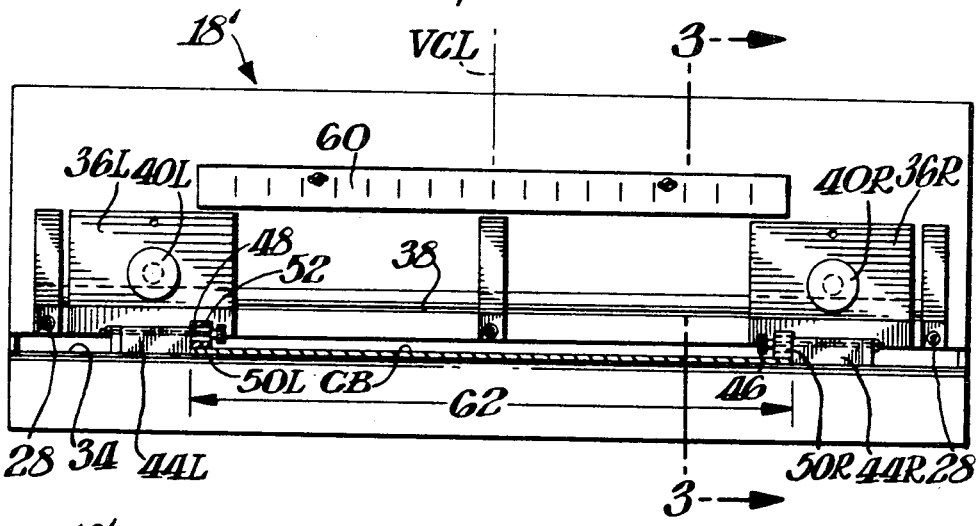
FIGS. 2 and 3 are a front elevation view and a side section view, respectively, of an alternate in-feed arrangement.
Figure 3:
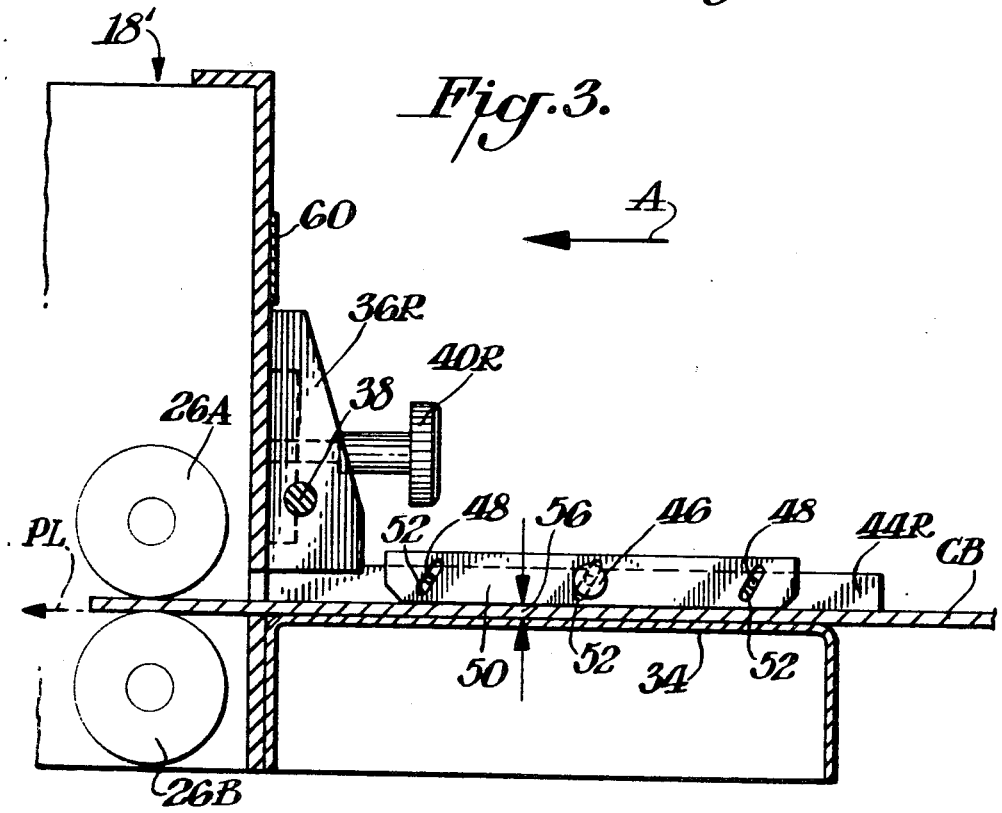

Alternatively, individual circuit boards CB may be manually fed into the apparatus 10 through an in-feed arrangement 18' shown in FIGS. 2 and 3. The in-feed arrangement 18' is attachable to the front of the apparatus 10 by any suitable means, as be screws 28. The in-feed arrangement 18' includes a planar tray 34 having laterally adjustable guides 36L and 36R movably disposed along a fixed guide shaft 38. The guides 36 are supportable in a fixed location along the shaft 38 by lock nuts 40. Each guide 36 includes a forwardly projecting arm 44 having a lug 46 and guide pins 48 extending therefrom in a confrontational relationship with the lug 46 and the pins 48 on the opposite arm 44. A runner 50 having inclined slots 52 therein is received on the lug 48 and guide pins 50 extending from each of the arms 44. The runners 50 slide in the slots 52 with respect to the lug 46 and pins 48 to increase or decrease the vertical dimension 56 of an in-feed slot defined between the lower surface of the runners 50 and the upper surface of the planar tray 34. By limiting the vertical dimension 56 of the in-feed slot it is possible for an operator to insert only a single board CB into the apparatus 10 at any given time. Because of the thickness limitation of the in-feed slot, circuit boards CB may only be serially introdced into the inlet nip rollers 26 of the apparatus 10, thus preventing overlap of boards.

The spacing 62 defined between the confronting portions of the arms 44 serves to channelize the circuit boards CB into a path of travel symmetrical about the vertical centerline VCL extending through the apparatus 10. The transverse dimension of the spacing 62 between the arms 44 is indicated by an indicia 60. The transverse dimension of the path of travel is adjustable to correspond to the planar width dimension of the boards CB being laminated. The individual circuit boards CB are conveyed through the apparatus 10 along a pass line PL (FIG. 1). The pass line PL is an imaginary horizontal line extending from the inlet to the outlet of the apparatus along which the lower surface of a board CB is conveyed as the board moves through the various regions of the apparatus. The pass line PL may be defined as a line extending through the apparatus 10 that lies a predetermined fixed distance D from a predetermined reference datum, as the floor of the workspace on which the apparatus is disposed. Hereafter, the pass line PL shall serve as a vertical reference datum for locating structural elements within the apparatus 10 as being either thereabove or therebelow. The vertical centerline VCL through the apparatus 10 shall serve a horizontal reference datum for locating structural elements as being either right or left as viewed from the in-feed end of the apparatus 10 (FIG. 2). Circuit boards CB are conveyed along the pass line PL in a path of travel in the direction of arrow A (FIG. 1) extending from the in-feed end of the apparatus, through the cleaning section 12, the rinsing section 14, to the outlet of the laminating section 16.

The cleaning section 12 is defined between the inlet pair of nip rollers 26A and 26B (respectively above and below the pass line PL) and a second, outlet, pair of nip rollers 64A and 64B. Intermediate pairs of nip rollers 66A and 66B, 68A and 68B and 69A and 69B are disposed within the cleaning section 12 and cooperate with the rollers 26 and 64 to define a conveyor by which circuit boards CB are transported through the cleaning section 12 along the pass line PL. Intermediate between the nip rollers 66 and 68 is a lower surface brush scrubber 72 while an upper surface brush scrubber 74 is disposed between the nip rollers 64 and 69. The brush scrubber 72 is located below the pass line PL while the brush scrubber 74 is disposed above the pass line PL. Each scrubber acts against an associated backup roller 76A and 76B, respectively. The nip rollers 26, 64, 66, 68 and 69 are driven by a drive motor 78 appropriately geared such that circuit boards CB are passed through the cleaning section 12 at a first predetermined linear speed (typically eight linear feet per minute). It is at this speed that boards CB exiting the cleaning section 12 enter the adjacent rinsing section 14 through the nip rollers 64A and 64B. In the cleaning section 12 the abrasive action of the nylon bristle brushes with silica carbide inserts on the srubbers 72 and 74 respectively remove oxide and a thin layer of material from both the lower and upper surfaces of the board CB. The scrubbers 72 and 74 are rotated by a drive motor (not shown) and are also movable with respect to the vertical center line VCL of the apparatus 10. This transverse motion of the brush scrubbers assists their removal of the thin layer of material from the surface of the circuit board CB. Suitable for use as the cleaning section 12 is a Surface Finisher sold by Chemcut, Inc. of State College, Pennsylvania under Model No. 107. Of course any other suitable surface cleaner may be utilized.

Between the pair of nip rollers 64 at the exit of the cleaning section 12 and a pair of wetting rolls 82 lies the rinsing section 14. In this section the now-scrubbed surfaces of the circuit boards CB are rinsed by the application of a water spray from nozzles 84A and 84B arranged above and below the pass line PL, respectively. Suitable baffles 85 are provided to prevent water from leaving the portion of the rinsing section in the vicinity of the nozzles 84. The boards CB are air dried by streams of air directed theretoward from an array 86 of air knives. The rinsing and air-dry procedure removes copper fines and other extraneous matter from the scrubbed surfaces of the boards preparatory to the introduction of the boards to the laminating section 16.

The wetting rolls 82 contain an inner core formed of a hollow stainless steel rod having radially extending slots therethrough. Wetting solution is introduced to the interior of the core through rotary unions which also act as trunnions to support the wetting rolls 82 in the frame of the apparatus 10. Disposed around the exterior of the core is an outer layer of porous polyethylene. This layer is covered by a fabric sock outer covering. The polyethylene layer and outer fabric sock meter the wetting solution onto the surface of the boards. The wetting rolls 82 are connected to a drive motor 83 and are preferably driven at the same linear speed as nip rollers 64.

The boards CB are conveyed through the rinsing section 14 by a conveyance arrangement including a V-roller drive 90. The V-roller drive includes an array of roller elements 92 which rotate on axes 94 perpendicular to the pass line PL. The rollers 92 have a peripheral slot therein which receives the lateral edges of each board CB and guides the edges of the boards CB into contact with a driving surface disposed at the base of the slot. The driving surface defines a predetermined friction angle with the axis 94 of the roller. The rollers 92 drive each circuit board CB from the nips 64 to the wetting rolls 82. The V-roller drive 90 translates an otherwise unrestrained board CB at a speed greater than the linear speed at which the board is driven while under the influence of either the nip rollers 64 or the wetting rolls 82. However, whenever a board is restrained (by either the nip rollers 64 or otherwise) the same friction angle allows the rollers 92 to slip against the edge of the board. The V-rollers 92 in the V-roller drive are driven by a geared interconnection 93 with the motor drive 78 at a velocity greater than the velocity at which the nip rollers 64 are driven.

The V-roller drive 90 translates boards from the exit of the nip rollers 64 into abutting relationship with the trailing edge of a preceding board already engaged in the wetting rolls 82. Board overlap is prevented by the vertical dimension of the peripheral slot in the rollers 92 and by horizontally disposed plates 96 arranged to form slots which register with the slots in the rollers 92. The slots in the rollers 92 and those formed by the plates 96 (which engage the edges of the boards in the regions between V-rollers 92) prevent the occurrence of board overlap. A detector arrangement 98 is located upstream of the wetting rolls 82 to detect gaps between boards entering the wetting rolls 82. A gap (or nonabutting relationship) between boards is detected by the detector 98 and a signal generated thereby is applied to a motor control network 100 which results in an increased speed of rotation of the V-rollers 92 and also an increased speed of boards through the cleaning section 12. As a further result of the increase of board speed, there is an increase in the rate at which circuit boards CB are fed by the in-feed arrangement 18 (or an operator if the manual in-feed 18' is used) to the apparatus 10.

Still with reference to FIG. 1 the laminating section 16 is disposed between the wetting rolls 82 and the nose of wedges 102. In the laminating section 16 the upper and lower surfaces of the circuit board CB are provided with a layer of dry film photopolymer resist through the action of a pair of laminating rolls 104A and 104B. The laminating rolls 104 are driven by a motor 105.

A supply of photopolymer resist material for the upper and lower surfaces of the circuit boards is respectively stored on supply rolls 106A and 106B. The photopolymer resist material includes a web or film of the resist material itself supported on a substrate or backup strip of any suitable material. From the supply rolls 106 the resist material is trained over guide rolls 108 and into the gap between the laminating rolls 104. It is between the laminating rolls 104 that the film resist is adhered by the application of heat and pressure to the surface of the circuit board. The backup strip, now forming the outer layers of a sandwich which includes a laminate (formed of the circuit board and the resist material adhered thereto) extends through the apparatus 10 to and through the wedges 102. At the nose of the wedges 102 the backup strip diverges sharply and is peeled away from the resist material, leaving the laminated sandwich of the board having upper and lower layers of photopolymer resist material thereon.

The backup strip is taken-up by take-up rolls 110 each having a continuously slipping clutch tension device 111 associated therewith. The drive sprockets for the laminating rolls 104 and for the take-up rolls 110 are driven by the same motor 105. Due to a difference in the size of the drive sprockets, the speed of the drive sprocket for the take-up rolls 110 is greater than the speed of the drive sprocket for the laminating rolls 104. However, due to the provision of the continuously slipping clutch tensioning device 111, the mandrel of slipping clutch tensioning device 111, the mandrel of each of the take-up roll is rotated at a lesser angular speed, thus controlling the tension force applied to the backup strip by the rolls 110. The clutch tensioning device is discussed in full detail herein.

An array of sensors 116, 118, and 120 are disposed at predetermined locations in the laminating section 16. Each sensor 98, 116, 118 and 120 comprise a phototransmitter T and a photoreceiver R pair. In operation, the phototransmitter T is disposed below the pass line P1 facing upwardly, while the photoreceiver R is disposed above the pass line PL facing downwardly. The first sensor 116 is arranged to generate a signal to a control arrangement 124 when the leading edge of the first circuit board in the train of boards passing the sensor 116. This signal initiates operation of the drive motor 105 which drives laminating rolls 104 and the the take-up rolls 110. A signal from the second sensor 118 that the leading end of the first circuit board is moving therepast initiates the closing of the laminating rolls 104. The laminating rolls 104 close just as the leading edge of the first board enters the nip thereof. When the trailing edge of the last board passes the sensor 120 a signal is generated thereby representative of that fact and the laminating rolls 104 are opened. For clarity of illustration, only the photoreceivers R for the sensors 116, 118 and 120 are shown in FIG. 1.

A crank mechanism diagrammatically indicated at 121 facilitates the opening and closing of the rolls 104.

As noted earlier the now-laminated circuit board (or "laminate") is advanced through the laminating section 16 downstream of the laminating rolls by the action of the take-up rolls 110. The take-up action of the rolls 110 draws the laminate through the pair of wedges 102 and at the wedges the backup strip diverges sharply toward the take-up rolls 110 and is thereby removed from the surface of the film which has been heat-laminated to the board. While any portion of the laminate is still within the apparatus the laminate is subjected to a restraining force which tends to resist any displacing force imposed on the laminate in the direction of arrow A.

As the laminate begins to emerge from the nose of the wedges 102 a detector 132 arrangement (identical with the detector 98) generates a signal to a control network 134 over a line 302. The speed at which the laminate leaves the wedges 102 is monitored by a shaft encoder 135 arranged proximal to the drive sprocket for the laminating rolls 104 and a signal provided on a line 308 to the control network 134. When a predetermined portion of the board is through the wedges 102, gripping elements 136 which form a part of a gripping arrangement 130 grasp the laminate on opposite sides thereof. Simultaneously a cylinder 138, also part of the gripping arrangement 130, is activated which applies a force acting in the direction 140 (parallel to the arrow A) drawing the gripping elements 136 and the laminate grasped thereby away from the wedges 102. However, so long as the laminate is engaged between the wedges 102 the force exerted by the cylinder 138 is insufficient to dislodge the laminate from the interior of the apparatus. Once the trailing edge of the laminate clears the wedges 102 the displacement force exerted by the actuator 138 becomes dominant and the laminate jerks in the direction 140 and the laminate is lead onto rollers 142. Upon the imposition of an impulse force the resist severs along a tear line substantially coextensive with the trailing edge of the laminate.

The carriage on which the gripping elements are carried includes a magnet 144. A magnetic sensor switch 146 responds to the proximity of the magnet 144 thereto and provides a signal on a line 310 to the control network 134 that indicates that the gripping elements 136 have reached the end of travel. At the occurrence of the signal the gripping elements 136 release their grasp on the laminate and the actuator 138 is energized in an opposite direction returning the gripping elements 136 to their initial position to await the exit of the next successive laminate from the wedges 102. The laminates may now be manually or automatically stacked, or if desired, applied to other process steps.

With reference now to FIGS. 4 through 10 the continuously slipping clutch tensioning device 111 is shown in connection with the upper take-up roll 110A. It is to be understood that the continuously slipping clutch tensioning device used with the lower take-up roll 110B is identical to that used in connection with the take-up roll 110A and discussed in detail herein.

Figures 4, 5, 6, 7, 8:
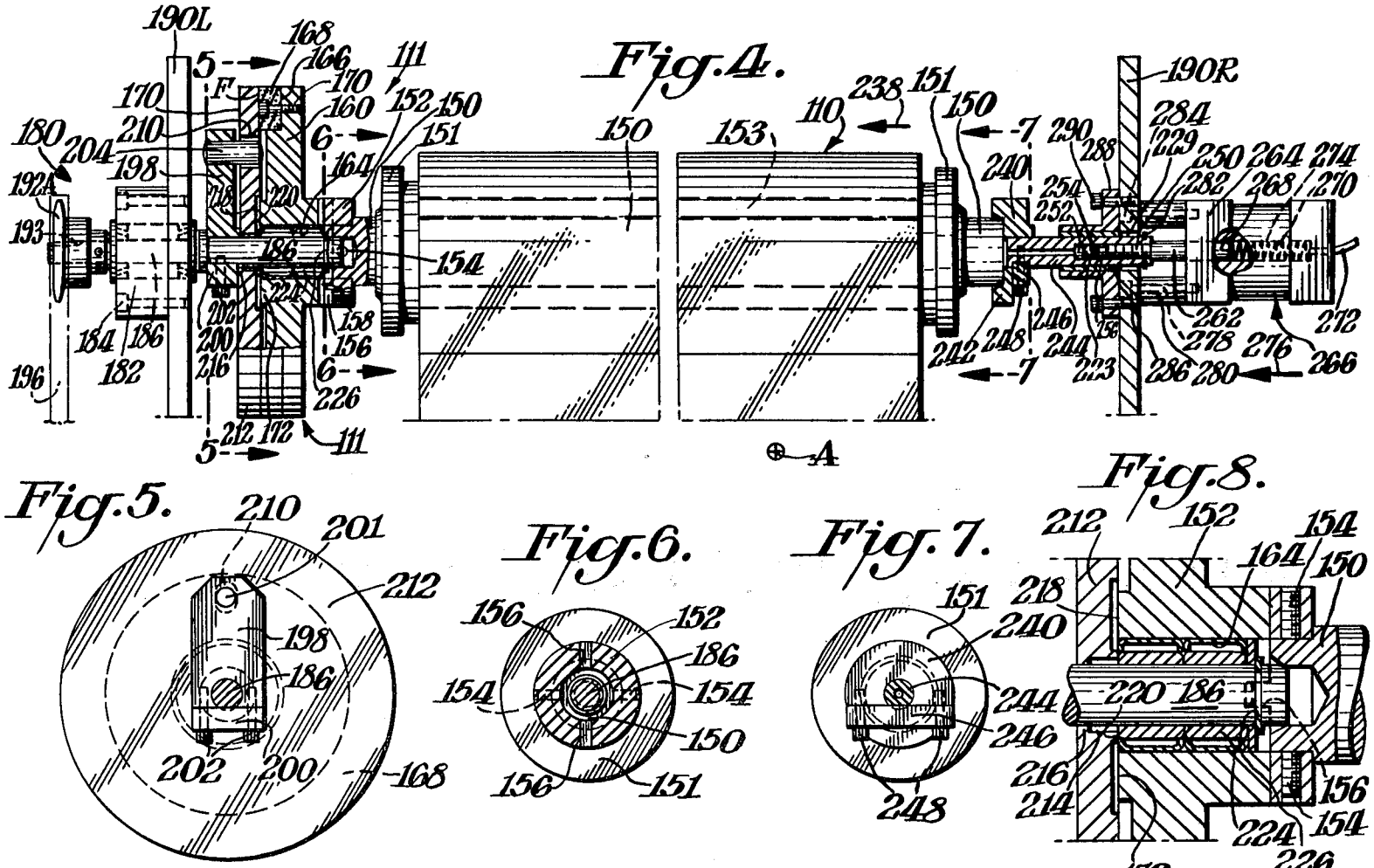
FIG. 4 is an elevation view of take-up roll having a continuously slipping clutch tensioning device in accordance with the instant invention.
FIGS. 5, 6 and 7 are sectional views taken along section lines 5—5, 6—6 and 7—7, respectively in FIG. 4.
FIG. 8 is an expanded view of a portion of FIG. 4 showing the mounting of the drive plate in accordance with the instant invention; and, FIGS. 9 and 10 are a side elevation and a schematic diagram, respectively, of the laminating roll and take-up roll drive connections.

As seen in FIG. 4, the take-up roller 110 includes an axially extending mandrel 150 to which core chucks 151 have been mounted. The core chucks 151 support a plastic core 153 upon which the backup strip is wrapped at the mandrel is rotated. The mandrel 150 receives at a stepped and hollowed-out first end thereof an annular adapter 152. The adapter is secured to the first end of the mandrel 150 by a pair of diametrically opposed set pins 154 (FIG. 6). One surface of the adapter 154 carries diametrically opposed keys 156 which are received in corresponding keyways 158 on an annular clutch plate 160. The clutch plate 160 has a central axial opening 164 extending therethrough, the axis of the opening 164 being coincident with the axis of the mandrel 150 and of the hollowed-out portion at the first end thereof.

The clutch plate 160 has a peripheral notch 166 disposed thereon in which is received an annular clutch member 168. Suitable for use as the clutch member is a micarta ring, although any suitable similar material may be used. The clutch member 168 is secured to the clutch plate 160 in the notched region 166 thereof by an array of bolts 170.

Figure 9:
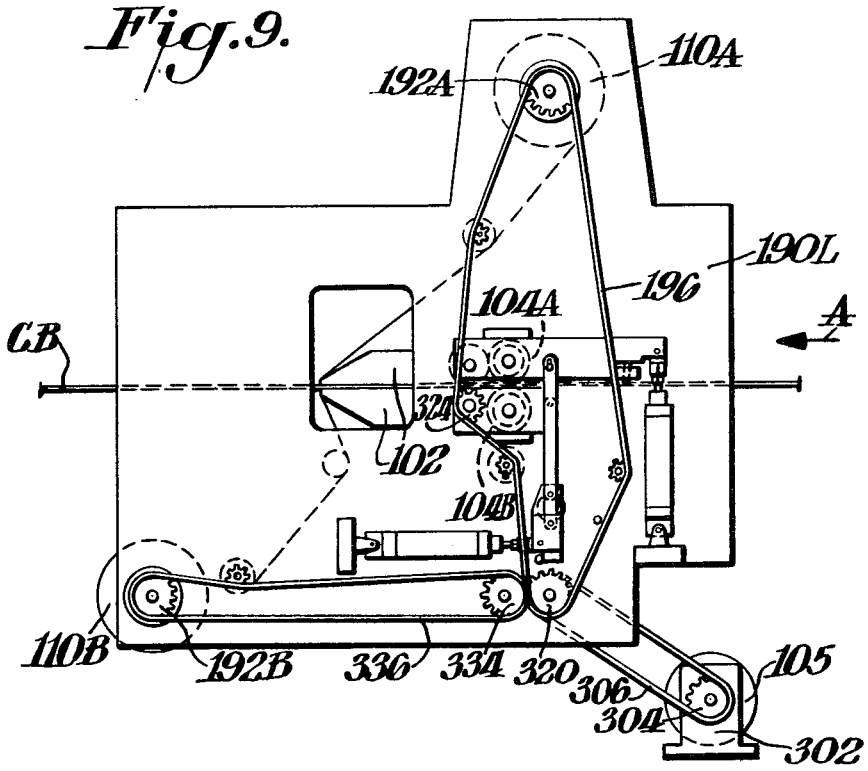
Figure 10:
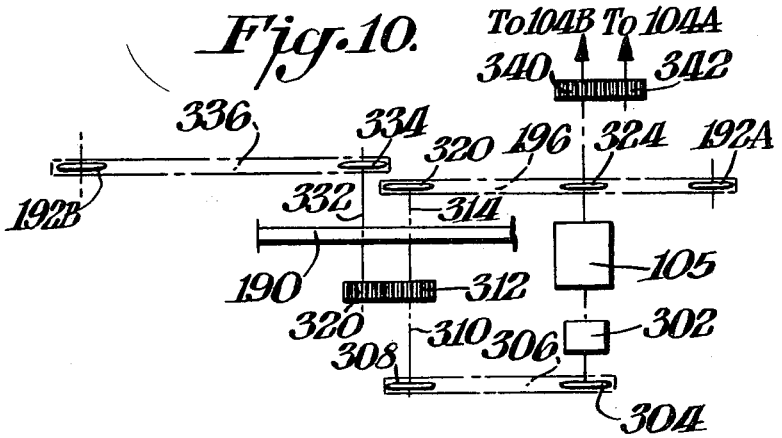

A take-up roller drive mechanism 180 includes a preloaded bearing assembly 182 such as that manufactured by Timken Bearing Company, New York, New York and sold under model number A6157-B (Cup) and L-21-549 (Cone). The bearing 182 is connected by an array of bolts 184 to the drive side wall 190L of the apparatus 10. A drive sprocket 192A is connected by a key and set screw 193 at the outward end of the shaft 186 of the bearing 182. Motive force for rotating the shaft 184 is derived from a drive motor 105 connected to the sprocket 192 by a chain 196, as shown in FIGS. 9 and 10.

The shaft 186 of the bearing assembly 182 is attached to a drive crank 198 by a lock plate 200 and bolts 202 (FIG. 5). Located near the periphery of the crank 198 is a drive pin 204.

The drive pin 204 is received within a slot 210 formed near the periphery of an annular drive plate 212. The central axial opening 214 of the plate 212 receives the shaft 186 of the bearing 182. The central portion of the plate 212 is cut away as at 214 surrounding the shaft 182, defining a relatively narrow radially inwardly extending tab 216 on which the drive plate 212 engages the shaft 186. The surface of the drive plate 212 confronting the clutch plate 160 is provided with an annular groove 218 which is in register with the raised portion 172 on the clutch plate 160. The radially inner boundary of the groove 218 defines a ridge 220.

The shaft 186 extends through the central opening 164 in the clutch plate 160 and into the hallowed-out end of the mandrel 150. Bushings 224 are disposed in the annulus between the exterior surface of the shaft 186 and the opening 164 in the clutch plate 160. The bushings 224 are axially restrained by the ridge 220 on the drive plate 210 and by a snap ring 226 fitted to the shaft 186.

A socket 240 receives the opposite end of the mandrel 150. The socket 240 is an annular member having a rim 242 adapted to accept and support the end of the mandrel 150. The socket 240 is secured to a rearwardly projecting shaft 244 by a lock plate 246 and lock bolts 248. The shaft 244 is counterbored as at 250. A first pressure pad 252, a ball 254 and a second pressure pad 256 are received within the counterbore 250 of the shaft 244. A threaded shaft 262 is engaged within the counterbored end 250 of the shaft 244. The shaft 262 abuts the second pad 256 and extends rearwardly through the wall 264 of a pressure actuator 266. Suitable for use as the actuator 266 is a device sold by Sheefer Corp., Cincinnati, Ohio under model number 200-4-18, 2-CLA-D-.625. The inner surface 268 of the shaft 262 forms a piston surface against which acts pressurized fluid admitted into the cylinder 270 of the actuator 266 through a fitting 272. The shaft 262 is also spring loaded by a bias spring 274 acting in a direction of arrow 276. The actuator 266 is mounted to the sidewall 190R of the apparatus 10 by bolts 278 extending through spacers 280. A snap ring 282 is fitted about the exterior of the shaft 244. The conjoined shafts 244 and 262 extend through an opening 284 in the side wall 190R and are supported for rotation on a bearing 286 mounted in a retainer 288 secured to the side wall by bolts 290.

With reference to FIGS. 9 and 10, respectively shown are a side elevation view and a schematic diagram illustrating the drive train for the laminating rolls 104 and the take-up rolls 110.

The motor 105 is mounted beneath the apparatus 10 and is connected in a driving relationship through a gear box 302 to a drive sprocket 304. Suitable for use as the motor 105 is a device manufactured by Minarik Electric Co., Los Angeles, California and sold under model number 56-CB/504-06-018. The gear box 302 may be that manufactured by Hub City Division of Safeguard Power Co., Aberdean, South Dakota and sold under model number 134. The sprocket 304 is connected by a chain 306 to a drive sprocket 308 (FIG. 10). The sprocket 308 is in turn connected by a shaft 310 to a gear 312. The shaft 314 of the gear 312 extends through the drive side wall 190L where it engages a drive sprocket 320. The drive sprocket 320 is connected through the chain 196 to a sprocket 324 associated with the laminating roll 140B and also to the drive sprocket 192A associated with the take-up roll 110A. The gear 312 is meshed with a second gear 330 (FIG. 10) the shaft 332 of which extends through the drive side wall 190L to a drive sprocket 334. The drive sprocket 334 is connected by a chain 336 to a drive sprocket 192B associated with the lower take-up roll 110B. The sprocket 324 is connected by a shaft 338 to a gear 340 (FIG. 10) fixed to the lower laminating roll 140B. The shaft 340 engages a gear 342 which is fixed to the upper laminating roll 104A.

In operation, the actuator 266, when pressurized, imposes an axially directed force also acting in the direction of the arrow 276. The axially directed force on the mandrel 150 urges the clutch material 168 into a friction interface F with the drive plate 212. The drive plate 212 is rotated by the motor 105 through its interconnection through the sprocket 192A, bearing shaft 186, drive crank 198 and drive pin 204 at a first angular velocity. Rotational force is imparted through the friction interface F to rotate the mandrel 150 and the take-up roll 110 mounted thereon.

The speed at which the mandrel 150, and therefore, the take-up roll 110A is rotated is dependent upon the magnitude of the pressure force imposed by the actuator 266. The clutch material continuously slips along the interface F with the drive plate, thus permitting the mandrel to rotate at a second rotational speed less than the speed at which the sprocket 192A is driven. This permits only that tension force as is necessary to take-up the backup strip to be imposed thereon.

Any misalignments between the drive plate 198 and the clutch plate 160 may be accommodated by the self-aligning rocking motion of the drive plate 212 on the surface 216 between it and the shaft 186. This insures that the interface F between the clutch material 168 and the drive plate 212 is maintained at all points.

To replace a roll 110A when full, the socket 242 is urged against the bias of the spring 270. This action releases the end of the mandrel 150 and permits a replacement mandrel 150 (having an adapter 152 thereon) to be inserted in its stead.

Those skilled in the art having benefit of the teachings hereinabove set forth may effect modifications thereto. Such modifications are to be construed as lying within the scope of the present invention, as defined by the appended claims.

What is claimed is:

1. A tensioning device for a roll adapted to wrap a web thereupon, the tension imparted to the web being functionally related to the velocity of the roll, the device comprising:

a drive member able to be driven at a first predetermined angular velocity;

a clutch member connectable to a first end of the roll, the clutch member having a clutch material thereon;

means for imposing a predetermined bias force for biasing the clutch member and the drive member into abutting contact along a friction interface between the clutch material and the drive member, the clutch member continuously slipping along the interface with respect to the drive member as the drive member is driven at the first angular velocity to impart a second lesser, angular velocity to the roll, a socket movable with respect to the second end of the roll from a first, engaged, position to a second, released, position with respect to the roll; and means for biasing the socket to the first, engaged, position.

* * * * *